United States Patent [19]

Kondziolka et al.

[11] Patent Number: 4,882,688

[45] Date of Patent: Nov. 21, 1989

[54] COMPUTER-CONTROLLED METHOD AND APPARATUS FOR MAKING BINGO CARDS

[75] Inventors: Stanley F. Kondziolka, Markham; Henry Klein, Thornhill, both of Canada

[73] Assignee: Demco Bingo Inc., Thornhill, Canada

[21] Appl. No.: 128,920

[22] Filed: Dec. 4, 1987

Related U.S. Application Data

[63] Continuation-in-part of Ser. No. 823,187, Jan. 27, 1986, abandoned.

[30] Foreign Application Priority Data

Dec. 5, 1986 [CA] Canada ..... 524687

[51] Int. Cl.[4] ..... G06F 15/44; A63F 3/06

[52] U.S. Cl. ..... 364/519; 364/471; 273/269

[58] Field of Search ..... 364/519, 523, 468, 469, 364/470, 471, 717, 518, 410; 270/1.1, 4, 18, 52; 273/236, 269, 237

[56] References Cited

U.S. PATENT DOCUMENTS

| | | | |
|---|---|---|---|
| 3,653,026 | 3/1972 | Hurley | 273/237 |
| 3,790,768 | 2/1974 | Chevalier et al. | 364/717 |
| 3,822,876 | 7/1974 | Frain | 273/269 |
| 3,895,807 | 7/1975 | Friedman | 273/237 |
| 4,270,774 | 6/1981 | Barnes | 273/269 |
| 4,332,389 | 6/1982 | Loyd, Jr. et al. | 273/269 |
| 4,378,940 | 4/1983 | Gluz et al. | 273/269 |
| 4,398,708 | 8/1983 | Goldman et al. | 270/18 |
| 4,448,127 | 5/1984 | Frain | 270/1.1 |
| 4,455,025 | 6/1984 | Itkts | 273/269 |
| 4,475,157 | 10/1984 | Bolan | 364/410 |
| 4,527,798 | 7/1985 | Siekierski et al. | 364/717 |
| 4,611,811 | 9/1986 | Haase | 273/269 |

FOREIGN PATENT DOCUMENTS

| | | | |
|---|---|---|---|
| 1584477 | 2/1981 | United Kingdom | 364/717 |

*Primary Examiner*—Gary V. Harkcom
*Assistant Examiner*—Raymond Bayerl
*Attorney, Agent, or Firm*—Sim & McBurney

[57] ABSTRACT

A computer uses a random number generator as the basis for formatting the number combinations of new bingo cards, and stores each new combination in memory. This proceeds until the number of generated and stored cards reaches a designated number, whereupon the computer scans the combinations in memory to detect duplicates, and removes combinations in such a way as to eliminate duplication. A high-spoeed, graphics printer, for example a laser printer, is then used and computer-controlled to print bingo cards on paper, using the number combinations in memory.

13 Claims, 2 Drawing Sheets

COMPUTER-CONTROLLED METHOD AND APPARATUS FOR MAKING BINGO CARDS

This is a continuation-in-part of U.S. application Ser. No. 823,187, filed Jan. 27, 1986, now abandoned.

This invention relates generally to the production of bingo cards in the form of sheets, ready to be used in establishments where bingo is played.

BACKGROUND OF THE INVENTION

The traditional conventional method of producing sheets containing representations of bingo cards involves the formulation by hand of the permutations of playable bingo cards, verification to avoid card duplication, and conventional printing equipment. In this conventional process, low unit costs can be maintained only by printing the bingo card representations on large paper sheets. Typically 36 cards would be printed on a sheet, consisting of 6 columns of 6 rows each. Naturally, in order to avoid card duplication among players at the same game, each card printed must be different from each other card printed for a given "lot" of cards, which may typically be 6,000 cards, 9,000 cards or 18,000 cards.

After the sheets have been printed, they are collated to produce a book which may, for example, have 20 pages. Conventional techniques make each page a different colour so that the different kinds of bingo games can be colour-coded. The use of different colours requires extra handling and costs.

After the large sheets of paper have been collated into stacks, they are cut into smaller sizes in a specific procedure. Then the individual pads of typically 5 to 30 pages long require gluing along one edge. This is normally done by hand.

It will thus be appreciated that, in the conventional printing method, the photographic techniques require a master printing plate for each large-sized sheet. This means that a large number of plates are required, and these plates must be protected and maintained, as well as being stored. Because many types of bingo are being played currently, again many master printing plates are required for each type.

A further disadvantage relating to the conventional technique is the necessity of purchasing and maintaining expensive printing and handling equipment. In addition, a large building space is required not only for the printing equipment, but for the storage of materials, including the plates.

Because a central printing source is required in order to maintain low equipment costs, the result is high shipping and freight costs, as well as scheduling problems.

Naturally, adequate numbers of well trained and expensive staff are required to do all of the above work.

The conventional system does not have the flexibility for inserting advertising material into the pads, which could be a source of revenue, nor is there any flexibility for format variety. Once the plates are prepared, they absolutely determine the nature of the end product.

There is a further no flexibility for language considerations, for example French, English, Spanish, Chinese, Arabic and other options.

Finally, the conventional method requires a high inventory of bingo card sheets to be kept in storage.

U.S. Pat. No. 4,448,127, issued May 15, 1984 to Frain, is typical of the prior art.

CO-PENDING APPLICATION

Reference is made to co-pending U.S. Patent application Ser. No. 165,183, entitled "METHOD OF MAKING BINGO CARDS", filed on March 7, 1988.

GENERAL DESCRIPTION OF THIS INVENTION

In view of the substantial drawbacks of the conventional method described above, it is an aim of an aspect of the invention to provide an improved method of making bingo cards, which does not require manual permutation formulations, printing plates, large working area, large storage capacity or large numbers of well-trained staff.

It is an aim of another aspect of this invention to provide a method of making bingo cards which has complete flexibility in terms of advertising capability, varying the format, creating new game types, utilizing different languages, setting up new decentralized manufacturing facilities, creating local employment and exporting the inventive concept.

It is an aim of another aspect of this invention to eliminate the necessity to keep a high inventory of bingo cards and plates in storage, and the requirement for a large building space and large working area.

It is an aim of yet another aspect of this invention to permit a much greater permutation base, which may be 36,000, 72,000, 144,000 or any other number of cards up to the maximum theoretical limit, which differs depending on the type of bingo game involved.

More particularly, this invention provides a method for making bingo cards, comprising the steps:

(a) generating a first plurality of random numbers utilizing the random number generating capability of a computer, (b) formatting on the basis of said first plurality of random numbers a first number combination for a first bingo card, utilizing the electronic processing capability of the said computer and a formatting program, (c) storing the first number combination for the first bingo card in an electronic or magnetic memory means, (d) generating a further plurality of random numbers utilizing the said random number generating capability, (e) formatting on the basis of said further plurality of random numbers a further number combination for a further bingo card, utilizing the electronic processing capability of the said computer and said formatting program, (f) storing the further number combination for the further bingo card in the memory means, (g) repeating steps (d), (e) and (f) in that order until the total of stored number combinations in the memory reaches a predetermined level, (h) using said electronic processing capability to scan the number combinations in the memory means in order to detect duplicates, (i) if required, revolving number combinations from the memory means in order to eliminate duplication, and (j) using a computer-controlled, high-speed graphics printer to print bingo cards on paper, utilizing the number combinations remaining in the memory means.

GENERAL DESCRIPTION OF THE DRAWINGS

One embodiment of this invention is illustrated in the accompanying drawings, in which.

DETAILED DESCRIPTION OF THE DRAWINGS

Figure 1:
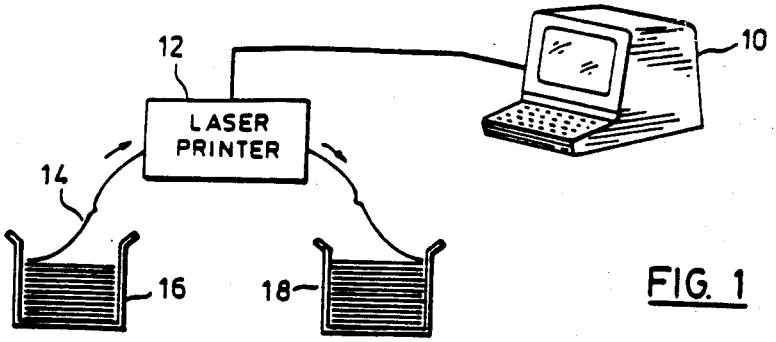
FIG. 1 is a schematic view of the computer controlled printing system of this invention.

In FIG. 1, a computer 10 is programmed to allow it to produce a large number of different specific bingo game cards using the letters B, I, N, G and O and permutations of the numbers of 1 to 75. The letters B, I, N, G and O may be substituted with alternate and associated letters or not used in certain variations of the bingo game. Alternatively, the computer 10 could select cards or patterns using more or less numbers than 75, as required in certain variations of the bingo game. The computer 10 could also be programmed with advertising and information regarding the different kinds of bingo games to be played.

Out of the large number of possible permutations for various cards, the computer controls the appropriate selection of cards and controls a high-speed laser printer 12 to which fan-folded paper 14 is fed from a first box 16. The fan-folded paper, after printing by the laser printer 12, is again folded up in a second box 18.

Alternatively, the laser printer could be controlled by a separate computer, and telephone lines, satellites, tapes, disks or any other storage means could be used to transfer data from the computer generating the cards to the computer controlling the printer.

The laser printer 12 is enabled to print not only the bingo cards, for example 6 or 12 per sheet, but also pertinent advertising and information regarding the games to be played. The sequential sheets of the fan-folded paper 14 are printed according to a predetermined format for specific types of bingo games.

It is to be understood that a laser printer, while presently preferred because it is the mosst advanced and fastest graphics printer in the art, may well be superseded by a different high-speed graphics printer which does not employ a laser. Therefore, the criteria for the printer 12 are that it be (a) a high speed printer, (b) a graphics printer, and (c) computer-controlled.

If desired, the fan-folded, printer paper in the second box 18 can be cut into smaller sizes, either before or after separating into "books" of bingo cards.

It will be appreciated that the fan-folded, printed paper could be separated into individual sheets sold separately to the bingo players, for example with 1 to 12 or more bingo cards per sheet, or could be divided into books or pads of a given number of sheets, these containing the cards to be played in a given evening.

Figure 2:
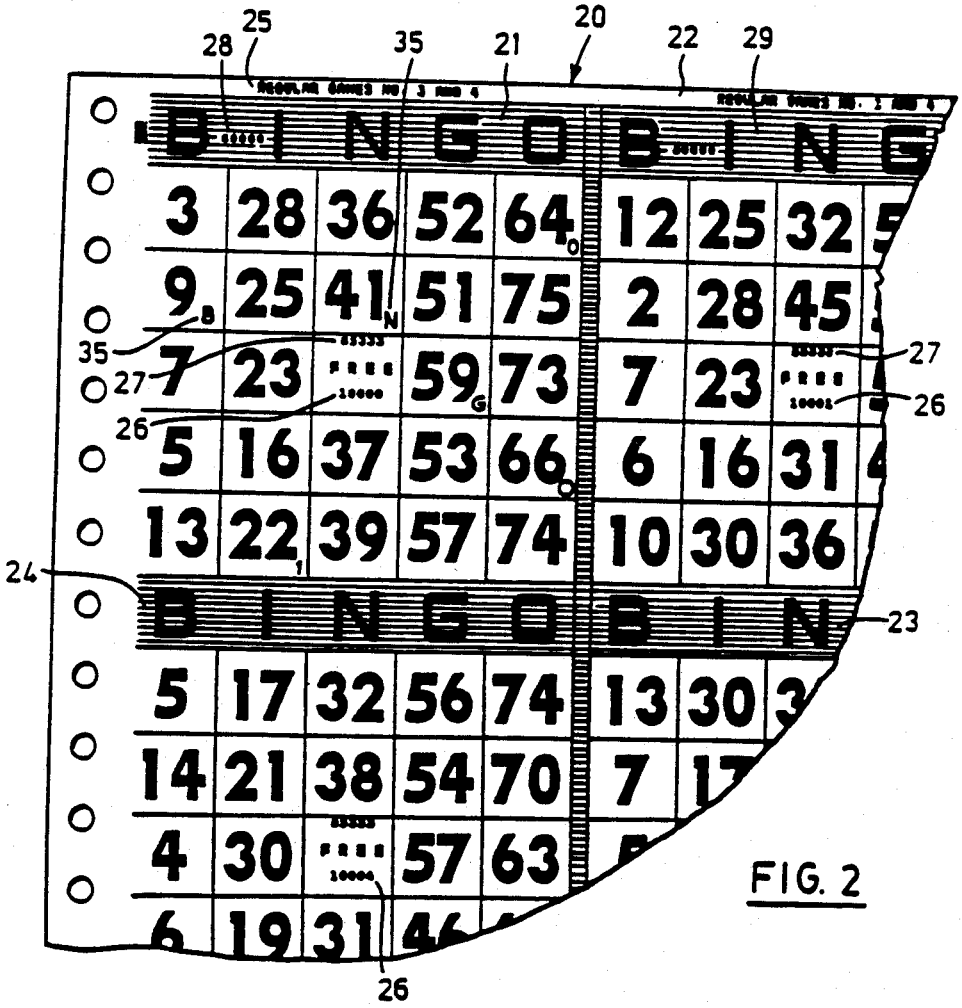
FIG. 2 shows a portion of a sheet printed in accordance with this invention.

Attention is now directed to FIG. 2, which shows a portion of one laser printed sheet 20 containing a number of printed bingo cards 21, 22, 23 and 24. It will be noted that each bingo card is identified by a different numeral 26 appearing in the centre square, this being the numeral identifying the particular permutation. The cards could also be printed with a different number 28 identifying the book to which the cards belong, and additional information could also be provided, for example the game type and/or game number 25.

In FIG. 2, the numeral 27 is a batch number, and identifies the date or customer purchase order.

It is not necessary to print in various colours, particularly in view of the fact that the laser printer can apply shaded patterns behind certain areas, to help the customer identify different games, or different cards to be played. An example of such shading occurs at the numeral 29 in FIG. 2, in which the background of the word "BINGO" has been shaded.

Sub-alphabetic or numeric characters 35 can be printed in randomly selected squares on the bingo cards, to facilitate the playing of special kinds of bingo games.

Figure 3:
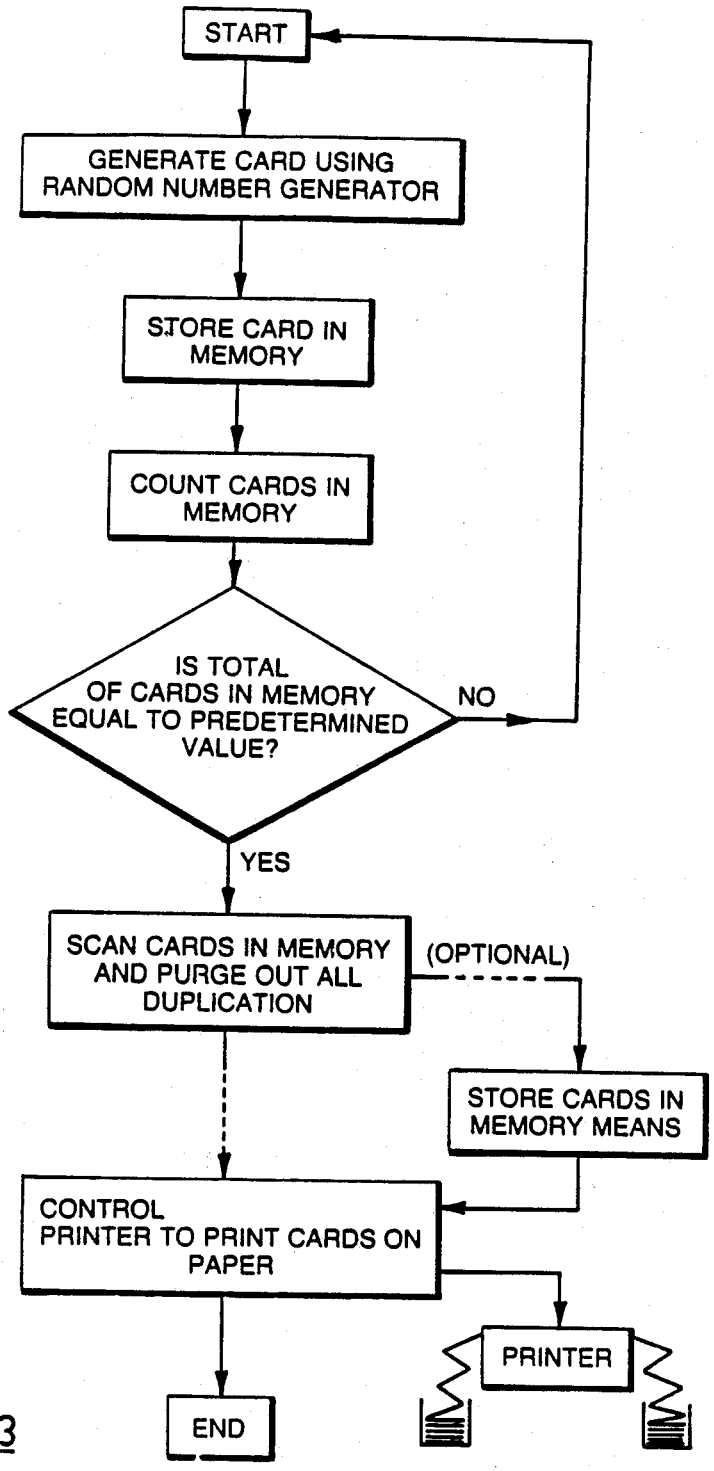
FIG. 3 is a flow sheet showing the steps followed by the computer program.

Attention is now directed to FIG. 3, which is a flow sheet showing the logical sequence followed by the computer program.

The computer first uses an internal random number generating means as the basis for formatting the number combination of a new bingo card, and that number combination is then stored in the computer memory. The computer keeps track of the total number of cards in memory by updating a running total by one increment each time a new number combination is stored. Each time the total count is incremented, the computer determines whether the total in memory is equal to a predetermined value. If the answer is "No", then the program returns to the "start" indicated by the box at the top of FIG. 3, to generate another card, store it, and again update the count.

If the answer is "Yes", i.e. the total of member combinations in the memory reaches the predetermined value, then the computer, but not necessarily the same computer, scans the number combinations in memory and purges out all duplication, if any, as defined by the rules of a specific bingo game. Techniques for achieving this are well-known, and need not be described here in detail.

The flow sheet shown in FIG. 3 then has an optional path to the right, where the purged cards can be stored in a memory means such as tapes, disks, or any other, for optional delivery to another computer. Alternatively, the same computer can be utilized to control the printing. Either way, the next central block in the flow sheet of FIG. 3 represents the control of a high-speed graphics printer to manufacture bingo cards by printing on paper the number combinations in the memory. The paper may be either rolls, individual sheets or fan-folded paper. The printer is represented schematically at lower right in FIG. 3.

The flow sheet of FIG. 3 does not include the steps involving the printing of advertising material and other indicia on the sheets.

While one embodiment of this invention has been described hereinabove and illustrated in the accompanying drawings, it will be evident to those skilled in the art that changes and modifications may be made therein without departing from the essence of this invention, as set forth in the appended claims.

The embodiments of the invention in which an exclusive property or privilege is claimed are defined as follows:

1. A method for making bingo cards, comprising the steps:

(a) generating a first plurality of random numbers utilizing the random number generating capability of a computer, (b) formatting on the basis of said first plurality of random numbers a first number combination for a first bingo card, utilizing the electronic processing capability of the said computer and a formatting program, (c) storing the first number combination for the first bingo card in an electronic or magnetic memory means, (d) generating a further plurality of random numbers utilizing the said random number generating capability, (e) formatting on the basis of said further plurality of random numbers a further number combination for a further bingo card, utilizing the electronic processing capability of the said computer and said formatting program, (f) storing the further number combination for the further bingo card in the memory means, (g) repeated steps (d), (e) and (f) in that order until the total of stored number combinations in the memory reaches a predetermined level, (h) using said electronic processing capability to scan the number combinations in the memory means in order to detect duplicates, (i) if required, removing number combinations from the memory means in order to eliminate duplication, and (j) using a computer-controlled, high-speed graphics printer to print bingo cards on paper, utilizing the number combinations remaining in the memory means.

2. The method claimed in claim 1, in which step (h) is preceded by sorting the number combinations in memory, using the numbers of each number combination as a sort key, thereby facilitating the step of scanning for duplicates.

3. The method claimed in claim 2, in which step (j) includes first electronically or magnetically storing the generated number combinations which remain after the elimination of duplication, then transferring the stored number combinations to a computer controlling the high-speed graphics printer.

4. The method claimed in claim 1, in which after the elimination of duplication, the number combinations are converted electronically to a format acceptable to the printing program.

5. The method claimed in claim 4, in which step (h) is preceded by sorting the number combinations in memory, using the numbers of each number combination as a sort key, thereby facilitating the step of scanning for duplicates.

6. The method claimed in claim 5, in which step (j) includes first electronically or magnetically storing on tapes, disks or any other appropriate storage device the number combinations which remain after the elimination of duplication, then transferring the stored number combinations to a computer controlling the high-speed graphics printer.

7. The method as claimed in claim 6, in which the printer is a laser printer.

8. The method claimed in claim 1, in which the printer is a laser printer.

9. An apparatus for making bingo cards, comprising:

computer-controlled, high-speed graphics printing means, random number generating means for generating random numbers, an electronic processing means for formatting different number combinations of bingo cards on the basis of different random numbers, electronic or magnetic memory means for storing formatted number combinations as a batch, electronic counting means for counting the number combinations as they are being stored and for determining when the total of all stored number combinations in a batch reaches a predetermined level, electronic comparator means operative after said level has been reached for comparing each formatted number combination with other number combinations stored in the memory means, and for eliminating duplication, and means for causing the printer to manufacture bingo cards by printing groups of the number combinations on sheet material.

10. The apparatus claimed in claim 9, in which said printing means is a laser printer.

11. The apparatus claimed in claim 9, which further includes sorting means for sorting the stored number combinations using at least some of the numbers of each combination as a sort key.

12. The apparatus claimed in claim 9, which further includes magnetic storage means for storing a batch of number combinations from which duplication has been eliminated, said storage means permitting the number combinations to be transmitted to a computer controlling said printer.

13. An apparatus for making bingo cards, comprising:

high-speed graphics printing means, random number generating means for generating random numbers, an electronic processing means for formatting different number combinations of bingo cards on the basis of different random numbers, electronic or magnetic memory means for storing formatted number combinations, electronic comparator means for comparing each formatted number combination with the other number combinations stored in the memory means and for eliminating any duplication, and means for causing the printer to print groups of cards on paper, utilizing the number combinations stored in the memory means.

* * * * *